US006777378B2

(12) United States Patent
Abraham et al.

(10) Patent No.: US 6,777,378 B2
(45) Date of Patent: Aug. 17, 2004

(54) MOLYBDENUM, SULFUR AND BORON CONTAINING LUBRICATING OIL COMPOSITION

(75) Inventors: William D. Abraham, South Euclid, OH (US); Jack C. Kelley, Chagrin Falls, OH (US); Jonathan S. Vilardo, Willoughby, OH (US)

(73) Assignee: The Lubrizol Corporation, Wickliffe, OH (US)

( * ) Notice: Subject to any disclaimer, the term of this patent is extended or adjusted under 35 U.S.C. 154(b) by 171 days.

(21) Appl. No.: 10/077,416

(22) Filed: Feb. 15, 2002

(65) Prior Publication Data

US 2003/0166477 A1 Sep. 4, 2003

(51) Int. Cl.[7] ..... C10M 141/12

(52) U.S. Cl. ..... 508/185; 508/230; 508/363; 508/364; 508/365; 508/371; 508/375

(58) Field of Search ..... 508/198, 199, 508/362, 363, 364, 365, 185

(56) References Cited

U.S. PATENT DOCUMENTS

| | | | | | |
|---|---|---|---|---|---|
| 3,405,064 | A | | 10/1968 | Miller | 252/51.5 |
| 3,541,014 | A | | 11/1970 | Le Suer | 252/49.7 |
| 4,178,258 | A | | 12/1979 | Papay et al. | 252/32.7 E |
| 4,234,435 | A | | 11/1980 | Meinhardt et al. | 252/51.5 |
| 4,258,822 | A | | 3/1981 | de Vries et al. | 252/46.4 |
| 4,265,773 | A | | 5/1981 | deVries et al. | 252/46.4 |
| 4,315,826 | A | | 2/1982 | Schlicht et al. | 252/46.4 |
| 4,370,248 | A | * | 1/1983 | Horodysky et al. | 508/199 |
| 4,507,216 | A | * | 3/1985 | Braid et al. | 508/199 |
| 4,584,115 | A | | 4/1986 | Davis | 252/49.6 |
| 4,692,257 | A | * | 9/1987 | Horodysky | 508/199 |
| 5,240,624 | A | | 8/1993 | Koch | 252/49.6 |
| 5,281,347 | A | | 1/1994 | Igarashi et al. | 252/42.7 |
| 5,595,964 | A | | 1/1997 | Bardasz | 508/423 |
| 5,605,880 | A | | 2/1997 | Arai et al. | 508/379 |
| 5,629,272 | A | * | 5/1997 | Nakazato et al. | 508/185 |
| 5,631,213 | A | * | 5/1997 | Tanaka et al. | 508/363 |
| 5,698,499 | A | * | 12/1997 | Baranski et al. | 508/198 |
| 5,759,965 | A | * | 6/1998 | Sumiejski | 508/186 |
| 5,916,851 | A | * | 6/1999 | Hosonuma et al. | 508/363 |
| 6,103,672 | A | | 8/2000 | Dunn et al. | 508/185 |
| 6,103,674 | A | * | 8/2000 | Nalesnik et al. | 508/334 |
| 6,165,235 | A | | 12/2000 | Kolp et al. | 44/331 |
| 6,228,818 | B1 | * | 5/2001 | Schwind et al. | 508/187 |
| 6,500,786 | B1 | | 12/2002 | Hartley et al. | 508/365 |

FOREIGN PATENT DOCUMENTS

| | | |
|---|---|---|
| EP | 0 609 623 | 2/1982 |
| WO | 96/06904 | 7/1996 |

* cited by examiner

*Primary Examiner*—Ellen M. McAvoy
(74) *Attorney, Agent, or Firm*—David M. Shold; Michael F. Esposito; Neil Duchez

(57) ABSTRACT

This invention relates to a lubricating oil composition, comprising:

(A) a base oil;

(B) a molybdenum and sulfur containing composition derived from a basic nitrogen containing compound, a molybdenum compound and carbon disulfide;

(C) a boron-containing compound; and (D) optionally a phosphorus containing compound, provided the phosphorus content of the lubricating oil composition does not exceed about 0.10% by weight.

18 Claims, No Drawings

MOLYBDENUM, SULFUR AND BORON CONTAINING LUBRICATING OIL COMPOSITION

TECHNICAL FIELD

This invention relates to molybdenum, sulfur and boron containing lubricating oil compositions. More particularly, this invention relates to a lubricating oil composition containing a molybdenum and sulfur containing composition, a boron-containing compound, and optionally a phosphorus containing compound provided the amount of phosphorus does not exceed about 0.10% by weight.

BACKGROUND OF THE INVENTION

For more than 40 years, zinc dialkyl dithiophosphates (ZDDP) have been used as antiwear and antioxidant additives in engine lubricating oil compositions. During this period typical concentrations of phosphorus contributed to the lubricating oil compositions by these compounds exceeded 0.10% by weight. However, ILSAC GF-3 requirements limit the amount of phosphorus that can be used in a lubricating oil composition to a maximum concentration of 0.10% by weight, and it is believed that GF-4 may limit the amount of phosphorus to a maximum concentration of 0.05% by weight. The problem therefore is to provide for a reduction in the amount of phosphorus-containing additives used in these lubricating oil compositions and yet provide the lubricating oil with required antiwear and antioxidant properties.

The use of molybdenum and sulfur containing compositions in lubricating oil compositions as antiwear agents and antioxidants is known. U.S. Pat. No. 4,285,822 discloses lubricating oil compositions containing a molybdenum and sulfur containing composition prepared by (1) combining a polar solvent, an acidic molybdenum compound and an oil-soluble basic nitrogen compound to form a molybdenum-containing complex and (2) contacting the complex with carbon disulfide to form the molybdenum and sulfur containing composition.

The replacement of part of the ZDDP in a lubricating oil composition with a molybdenum and sulfur containing composition of the type described in the above-mentioned patent provides the advantage of restoring antiwear and antioxidant properties lost with the reduction in ZDDP. However, a problem with these compositions is that they fail to pass the required GF-3/GF-4 Sequence VIII Bearing Corrosion Engine Test. This problem has been overcome with the present invention.

SUMMARY OF THE INVENTION

This invention relates to a lubricating oil composition, comprising:

(A) a base oil;

(B) a molybdenum and sulfur containing composition derived from a basic nitrogen containing compound, a molybdenum compound and carbon disulfide;

(C) a boron-containing compound selected from the group consisting of:

(C-I) a borated ester represented by one or more of the formulae (C-I-1)

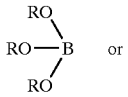

or (C-I-2)

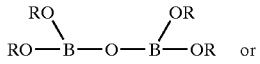

or (C-1-3)

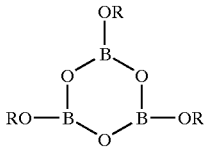

wherein in formulae (C-I-1), (C-I-2) and (C-I-3), each R is independently a hydrocarbon group and any two adjacent R groups may together form a cyclic group;

(C-II) at least one borated epoxide comprising the product made by reacting a boron reactant with one or more epoxides represented by the formula (C-II-1)

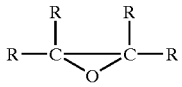

wherein in formula (C-II-1) each R is independently hydrogen or a hydrocarbon group and any two adjacent R groups may together form a cyclic group, with the proviso that when a single epoxide is used the total number of carbon atoms in the R groups does not exceed about 12, and when a mixture of epoxides is used the average on a mole basis for the total number of carbon atoms in the R groups for the mixture does not exceed about 12; and (C-III) mixture of (C-I) and (C-II); and (D) optionally a phosphorus containing compound provided the phosphorus content of the lubricating oil composition does not exceed about 0.10% by weight.

DETAILED DESCRIPTION OF THE INVENTION

The terms "hydrocarbon" and "hydrocarbyl" when referring to a group having a carbon atom directly attached to the remainder of a molecule denote a group having a hydrocarbon or predominantly hydrocarbon character within the context of this invention. These groups include the following:

(1) Purely hydrocarbon groups; that is, aliphatic, (e.g., alkyl or alkenyl), alicyclic (e.g., cycloalkyl or cycloalkenyl), aromatic, aliphatic- and alicyclic-substituted aromatic, aromatic-substituted aliphatic and alicyclic groups, and the like, as well as cyclic groups wherein the ring is completed through another portion of the molecule (that is, any two indicated substituents may together form an alicyclic group). Examples include methyl, ethyl, octyl, cyclohexyl, phenyl, etc.

(2) Substituted hydrocarbon groups; that is, groups containing non-hydrocarbon substituents which do not alter the predominantly hydrocarbon character of the group. Examples include hydroxy, nitro, cyano, alkoxy, acyl, etc.

(3) Hetero groups; that is, groups which, while predominantly hydrocarbon in character, contain atoms other than carbon in a chain or ring otherwise composed of carbon atoms. Suitable hetero atoms include, for example, nitrogen, oxygen and sulfur.

In general, no more than about three substituents or hetero atoms, and in one embodiment no more than one, will be present for each 10 carbon atoms in the hydrocarbyl group.

The term "lower" as used herein in conjunction with terms such as hydrocarbyl, alkyl, alkenyl, alkoxy, and the like, is intended to describe such groups which contain a total of up to 7 carbon atoms.

The term "oil-soluble" refers to a material that is soluble in mineral oil to the extent of at least about one gram per liter at 25° C.

The term "TBN" refers to total base number. This is the amount of acid (perchloric) needed to neutralize a material's basicity, expressed as milligrams of KOH per gram of sample.

The term "TAN" refers to total acid number. This is the amount of base (potassium hydroxide orsodium hydroxide) needed to neutralize a material's acidity, expressed as milligrams of KOH per gram of sample.

The Lubricating Oil Composition.

The inventive lubricating oil composition may be comprised of a major amount of base oil. The base oil may be present in an amount greater than about 50% by weight, and in one embodiment greater than about 60%, and in one embodiment greater than about 70%.

The inventive lubricating oil composition may have a viscosity of up to about 17 cSt at 10° C., and in one embodiment about 5 to about 17 cSt at 10° C., and in one embodiment about 6 to about 13 cSt at 100° C.

The inventive lubricating oil composition may have an SAE Viscosity Grade of 0W, 0W-20, 0W-30, 0W-40, 0W-50, 0W-60, 5W, 5W-20, 5W-30, 5W-40, 5W-50, 5W-60, 10W, 10W-20, 10W-30, 10W-40, 10W-50, 10W-60, 15W-30, 15W-40, 15W-50, 20W, 20W-50, or 30W.

The inventive lubricating oil composition may have a molybdenum content of about 25 to about 800 parts per million (ppm), and in one embodiment about 50 to about 700 ppm, and in one embodiment about 100 to about 600 ppm.

The inventive lubricating oil composition may have a sulfur content of about 0.02 to about 1.3% by weight, and in one embodiment about 0.07 to about 0.8% by weight, and in one embodiment about 0.1 to about 0.5% by weight.

The inventive lubricating oil composition may have a boron content of about 30 to about 600 ppm, and in one embodiment about 35 to about 400 ppm, and in one embodiment about 40 to about 200 ppm.

The inventive lubricating oil composition may have a phosphorus content of up to about 0.10% by weight, and in one embodiment up to about 0.09% by weight, and in one embodiment up to about 0.08% by weight, and in one embodiment up to about 0.075% by weight, and in one embodiment up to about 0.07% by weight, and in one embodiment up to about 0.06% by weight, and in one embodiment up to about 0.05%.

The ash content of the inventive lubricating oil composition as determined by the procedures in ASTM D-874-96 may be in the range up to about 1.2% by weight, and in one embodiment up to about 1.1% by weight, and in one embodiment from about 0.3 to about 1.2% by weight, and in one embodiment about 0.3 to about 1.1% by weight, and in one embodiment about 0.3 to about 1.0% by weight, and in one embodiment about 0.5 to about 1.0% by weight.

The inventive lubricating oil composition may have a chlorine content of up to about 100 ppm, and in one embodiment up to about 80 ppm, and in one embodiment up to about 50 ppm, and in one embodiment up to about 30 ppm, and in one embodiment up to about 10 ppm.

The inventive lubricating oil composition may be used as a lubricating oil composition for internal combustion engines such as gasoline powered engines and diesel engines, including passenger car engines and heavy duty diesel engines. In one embodiment, the inventive lubricating oil composition exhibits enhanced GF-4 Sequence VIII Bearing Corrosion Engine Test results.

(A) The Base Oil

The base oil used in the inventive lubricating oil composition may be selected from any of the base oils in Groups I–V as specified in the American Petroleum Institute (API) Base Oil Interchangeability Guidelines. The five base oil groups are as follows:

| Base Oil Category | Sulfur (%) | | Saturates (%) | Viscosity Index |
|---|---|---|---|---|
| Group I | >0.03 | and/or | <90 | 80 to 120 |
| Group II | ≦0.03 | and | ≧90 | 80 to 120 |
| Group III | ≦0.03 | and | ≧90 | ≧120 |
| Group IV | All polyalphaolefins (PAOs) | | | |
| Group V | All others not included in Groups I, II, III or IV | | | |

Groups I, II and III are mineral oil base stocks.

The base oil may be a natural oil, synthetic oil or mixture thereof. The natural oils that are useful include animal oils and vegetable oils (e.g., castor oil, lard oil) as well as mineral lubricating oils such as liquid petroleum oils and solvent treated or acid-treated mineral lubricating oils of the paraffinic, naphthenic or mixed paraffinic—naphthenic types. Oils derived from coal or shale are useful.

Synthetic lubricating oils include hydrocarbon oils such as polymerized and interpolymerized olefins (e.g., polybutylenes, polypropylenes, propylene isobutylene copolymers, etc.); poly(1-hexenes), poly-(1-octenes), poly (1-decenes), etc. and mixtures thereof; alkylbenzenes (e.g., dodecylbenzenes, tetradecylbenzenes, dinonylbenzenes, di-(2-ethylhexyl)benzenes, etc.); polyphenyls (e.g., biphenyls, terphenyls, alkylated polyphenyls, etc.); alkylated diphenyl ethers and alkylated diphenyl sulfides and the derivatives, analogs and homologs thereof and the like.

Alkylene oxide polymers and interpolymers and derivatives thereof where the terminal hydroxyl groups have been modified by esterification, etherification, etc., constitute another class of known synthetic lubricating oils that can be used.

Another suitable class of synthetic lubricating oils that can be used comprises the esters of dicarboxylic acids (e.g., phthalic acid, succinic acid, alkyl succinic acids, alkenyl succinic acids, maleic acid, azelaic acid, suberic acid, sebacic acid, fumaric acid, adipic acid, linoleic acid dimer, malonic acid, alkyl malonic acids, alkenyl malonic acids, etc.) with a variety of alcohols (e.g., butyl alcohol, hexyl alcohol, dodecyl alcohol, 2-ethylhexyl alcohol, ethylene glycol, diethylene glycol monoether, propylene glycol, etc.)

Esters useful as synthetic oils also include those made from $C_5$ to $C_{12}$ monocarboxylic acids and polyols and polyol ethers such as neopentyl glycol, trimethylol propane, pentaerythritol, dipentaerythritol, tripentaerythritol, etc.

The synthetic base oil may be a poly-alpha-olefin (PAO). Typically, the poly-alpha-olefins are derived from monomers having from about 4 to about 30 carbon atoms.

The synthetic base oil may be an oil derived from Fischer-Tropsch synthesized hydrocarbons. Fischer-Tropsch synthesized hydrocarbons are made from synthesis gas containing $H_2$ and CO using a Fischer-Tropsch catalyst. These hydrocarbons may require further processing in order to be useful as the base oil. For example, the hydrocarbons may be hydroisomerized, hydrocracked or dewaxed using known techniques.

Unrefined, refined and rerefined oils, either natural or synthetic (as well as mixtures of two or more of any of these) of the type disclosed hereinabove can be used as the base oil. Unrefined oils are those obtained directly from a natural or synthetic source without further purification treatment. Refined oils are similar to the unrefined oils except they have been further treated in one or more purification steps to improve one or more properties. Rerefined oils are obtained by processes similar to those used to obtain refined oils applied to refined oils which have been already used in service. Rerefined oils are also known as reclaimed or reprocessed oils and often are additionally processed by techniques directed to removal of spent additives and oil breakdown products.

(B) The Molybdenum and Sulfur Containing Composition.

The molybdenum and sulfur containing composition may be derived from a basic nitrogen containing compound, a molybdenum compound and carbon disulfide. In one embodiment, the basic nitrogen containing compound may be reacted initially with the molybdenum compound to form a molybdenum containing intermediate, and then the molybdenum containing intermediate is reacted with the carbon disulfide to form the desired molybdenum and sulfur containing composition. Alternatively, the basic nitrogen containing compound may be reacted initially with the carbon disulfide to form a sulfur containing intermediate, and then the sulfur containing intermediate may be reacted with the molybdenum compound to form the desired molybdenum and sulfur containing composition. In one embodiment, the molybdenum and sulfur containing composition is a molybdenum dithiocarbamate.

The basic nitrogen containing compound may be a nitrogen containing compound having a TBN of at least about 30, and in one embodiment at least about 50, and in one embodiment at least about 80. The basic nitrogen containing compound may be: the product made by the reaction of a carboxylic acid or reactive equivalent thereof with an alkylene polyamine; a hydrocarbyl amine; or a mixture thereof.

In one embodiment, the carboxylic acid or reactive equivalent thereof used to make the basic nitrogen containing compound may have about 8 to about 34 carbon atoms per molecule, and in one embodiment about 12 to about 24 carbon atoms. The acids may be monobasic acids or polybasic acids. The reactive equivalents include acid halides, anhydrides, and esters, including partial esters. The acids include fatty acids. Examples include lauric acid, myristic acid, palmitic acid, stearic acid, isotearic acid, oleic acid, linoleic acid, linolenic acid, arachidic acid, behenic acid, erucic acid, lignoceric acid, and the like. Tall oil fatty acids and coconut oil fatty acids may be used. Dimers and trimers of fatty acids may be used. The polybasic acids may be hydrocarbon substituted dicarboxylic acids, although tricarboxylic or tetracarboxylic acids may be used.

These include hydrocarbon substituted succinic acids or anhydrides. The hydrocarbon substituents on these polybasic acids may have about 6 to about 30 carbon atoms, and in one embodiment about 12 to about 24 carbon atoms, and in one embodiment about 12 to about 18 carbon atoms.

In one embodiment, the carboxylic acid or reactive equivalent thereof is a hydrocarbon substituted carboxylic acid or reactive equivalent made by reacting one or more alpha, beta olefinically unsaturated carboxylic acid reagents containing 2 to about 20 carbon atoms, exclusive of the carboxyl groups, with one or more olefin polymers. The olefin polymer may contain about 30 to about 500 carbon atoms, and in one embodiment 50 to about 500 carbon atoms, and in one embodiment about 50 to about 250 carbon atoms. In one embodiment, the olefin polymer has a number average molecular weight of about 750 to about 3000, and in one embodiment about 900 to about 2300.

The alpha-beta olefinically unsaturated carboxylic acid reagents may be either monobasic or polybasic in nature. Exemplary of the monobasic alpha-beta olefinically unsaturated carboxylic acid reagents include the carboxylic acids corresponding to the formula

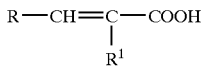

wherein R is hydrogen, or a saturated aliphatic or alicyclic, aryl, alkylaryl or heterocyclic group, and $R^1$ is hydrogen or a lower alkyl group. R may be a lower alkyl group. The total number of carbon atoms in R and $R^1$ typically does not exceed about 18 carbon atoms. Specific examples of useful monobasic alpha-beta olefinically unsaturated carboxylic acids include acrylic acid; methacrylic acid; cinnamic acid; crotonic acid; 3-phenyl propenoic acid; alpha, and beta-decenoic acid. The polybasic acid reagents may be dicarboxylic, although tri- and tetracarboxylic acids can be used. Exemplary polybasic acids include maleic acid, fumaric acid, mesaconic acid, itaconic acid and citraconic acid. Reactive equivalents of the alpha-beta olefinically unsaturated carboxylic acid reagents include the anhydride, ester or amide functional derivatives of the foregoing acids. A useful reactive equivalent is maleic anhydride.

The olefin monomers from which the olefin polymers may be derived are polymerizable olefin monomers characterized by having one or more ethylenic unsaturated groups. They can be monoolefinic monomers such as ethylene, propylene, butene-1, isobutene and octene-1 or polyolefinic monomers (usually di-olefinic monomers such as butadiene-1,3 and isoprene). Usually these monomers are terminal olefins, that is, olefins characterized by the presence of the group>C=$CH_2$. However, certain internal olefins can also serve as monomers (these are sometimes referred to as medial olefins). When such medial olefin monomers are used, they may be employed in combination with terminal olefins to produce olefin polymers that are interpolymers.

Generally the olefin polymers are homo- or interpolymers of terminal hydrocarbon olefins of about 2 to about 30 carbon atoms, and in one embodiment about 2 to about 16 carbon atoms. Typically, the olefin polymers are homo- and interpolymers of terminal olefins of 2 to about 6 carbon atoms, and in one embodiment 2 to about 4 carbon atoms.

In one embodiment, the olefin polymer is a polyisobutene (or polyisobutylene) obtained by the polymerization of a $C_4$ refinery stream having a butene content of about 35 to about 75% by weight and an isobutene content of about 30 to about 60% by weight in the presence of a Lewis acid catalyst such as aluminum chloride or boron trifluoride. These polyisobutenes may contain predominantly (that is, greater than about 50 percent of the total repeat units) isobutene repeat units.

The olefin polymer may be a polyisobutene having a high methylvinylidene isomer content, that is, at least about 50% by weight, and in one embodiment at least about 70% by weight methylvinylidenes. Suitable high methylvinylidene polyisobutenes include those prepared using a boron trifluoride catalyst. These are described in U.S. Pat. Nos. 4,152,499 and 4,605,808, which are incorporated herein by reference.

The carboxylic acid or reactive equivalent thereof may be a hydrocarbon-substituted succinic acid or anhydride wherein the hydrocarbon substituent has about 30 to about 500 carbon atoms, and in one embodiment from about 50 to about 500, and in one embodiment from about 50 to about 250 carbon atoms. In one embodiment, the hydrocarbon substituent is a polyisobutene group. The hydrocarbon substituent may have a number average molecular weight of about 750 to about 3000, and in one embodiment about 900 to about 2300.

In one embodiment, the hydrocarbon-substituted succinic acids or anhydrides are characterized by the presence within their structure of an average of at least about 1.3 succinic groups, and in one embodiment from about 1.5 to about 2.5, and in one embodiment form about 1.7 to about 2.1 succinic groups for each equivalent weight of the hydrocarbon substituent. The ratio of succinic groups to equivalent of substituent groups present in the hydrocarbon-substituted succinic acylating agent (also called the "succination ratio") can be determined by one skilled in the art using conventional techniques (such as from saponification or acid numbers). This is described in U.S. Pat. No. 4,234,435, which is incorporated herein by reference.

The conditions, i.e., temperature, agitation, solvents, and the like, for reacting an alpha, beta olefinically unsaturated carboxylic acid reagent with an olefin polymer, are known to those in the art. Examples of patents describing various procedures for preparing these compounds include U.S. Pat. Nos. 3,215,707; 3,219,666; 3,231,587; 3,912,764; 4,110,349; 4,234,435; and 6,165,235 and U.K. Patent 1,440,219. The disclosures of these patents are incorporated herein by reference.

The alkylene polyamines include those compounds represented by the formula

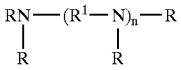

wherein n is from 1 to about 14; each R is independently a hydrogen atom, a hydrocarbyl group or a hydroxy-substituted or amine-substituted hydrocarbyl group having up to about 30 atoms, or two R groups on different nitrogen atoms can be joined together to form a $R^1$ group, with the proviso that at least one R group is a hydrogen atom, and $R^1$ is an alkylene group of 1 to about 10 carbon atoms, and in one embodiment about 2 to about 10 carbon atoms. $R^1$ may be ethylene or propylene. Alkylene polyamines where each R is hydrogen or an amino-substituted hydrocarbyl group with the ethylene polyamines and mixtures of ethylene polyamines are useful n may have an average value of from 1 to about 10, and in one embodiment about 2 to about 10, and in one embodiment about 2 to about 7, and in one embodiment about 4 to about 6. The alkylene polyamines include methylene polyamine, ethylene polyamines, propylene polyamines, butylene polyamines, pentylene polyamines, hexylene polyamines, heptylene polyamines, etc. The higher homologs of such amines and related amino alkyl-substituted piperazines are also included.

Alkylene polyamines that are useful include ethylene diamine, diethylene triamine, triethylene tetramine, tetraethylene pentamine, pentaethylene hexamine, propylene diamine, trimethylene diamine, hexamethylene diamine, decamethylene diamine, octamethylene diamine, di(heptamethylene) triamine, tripropylene tetramine, trimethylene diamine, di(trimethylene)triamine, N-(2-aminoethyl)piperazine, 1,4-bis(2-aminoethyl)piperazine, and the like. Higher homologs as are obtained by condensing two or more of the above-illustrated alkylene amines are useful, as are mixtures of two or more of any of the afore-described polyamines.

Alkylene polyamines are described in detail under the heading "Diamines and Higher Amines" in The Encyclopedia of Chemical Technology, Second Edition, Kirk and Othmer, Volume 7, pages 27–39, Interscience Publishers, Division of John Wiley and Sons, 1965, which is hereby incorporated by reference for the disclosure of useful polyamines. These compounds may be prepared by the reaction of an alkylene chloride with ammonia or by reaction of an ethylene imine with a ring-opening reagent such as ammonia, etc. These reactions often result in the production of somewhat complex mixtures of alkylene polyamines, including cyclic condensation products such as piperazines.

The alkylene polyamines may be those resulting from the stripping of the above-described alkylene polyamine mixtures. In this instance, lower molecular weight alkylene polyamines and volatile contaminants are removed from an alkylene polyamine mixture to leave as residue what is often termed "alkylene polyamine bottoms". In general, alkylene polyamine bottoms can be characterized as having less than about 2% by weight, and in one embodiment less than about 1% by weight material boiling below about 200° C. In one embodiment, the alkylene polyamine bottoms are ethylene polyamine bottoms. These may contain less than about 2% by weight total diethylene triamine (DETA) or triethylene tetramine (TETA). A sample of an ethylene polyamine bottoms obtained from the Dow Chemical Company of Freeport, Tex. designated "E-100" shows a specific gravity at 15.6° C. of 1.0168, a percent nitrogen by weight of 33.15 and a viscosity at 40° C. of 121 centistokes. Gas chromatography analysis indicates that this sample contains about 0.93% "Light Ends" (most probably DETA), 0.72% TETA, 21.74% tetraethylene pentamine and 76.61% pentaethylene hexamine and higher (by weight). The alkylene polyamine bottoms may include cyclic condensation products such as piperazine and higher analogs of diethylenetriamine, triethylenetetramine, and the like. The stripped alkylene polyamines disclosed in U.S. Pat. No. 5,792,730 may be used; this patent is incorporated herein by reference.

The reaction between the carboxylic acid or reactive equivalent thereof and the alkylene polyamine may be carried out under conditions that provide for the formation of the desired product which may be an amide, an imide, a salt, or a mixture thereof. Typically, the reaction is carried out at a temperature in the range from about 50° C. to about 250° C., and in one embodiment from about 80° C. to about 220° C.; optionally in the presence of a substantially inert organic liquid solvent/diluent, until the desired product has formed. In one embodiment, the carboxylic acid or reactive equivalent and the alkylene polyamine are reacted in amounts sufficient to provide from about 0.3 to about 3 equivalents of carboxylic acid or reactive equivalent thereof per equivalent of alkylene polyamine. In one embodiment, this ratio is from about 0.5:1 to about 2:1, and in one embodiment about 0.5:1 to about 1:1.

The number of equivalents of the carboxylic acid or reactive equivalent thereof depends on the total number of carboxylic functions present which are capable of reacting with the alkylene polyamine. For example, there would be two equivalents in an anhydride derived from one mole of olefin polymer and one mole of maleic anhydride.

The weight of an equivalent of an alkylene polyamine is the molecular weight of the alkylene polyamine divided by the total number of nitrogens present in the molecule. The weight of an equivalent of a commercially available mixture of alkylene polyamines can be determined by dividing the atomic weight of nitrogen (14) times 100, that is 1400, by the % N contained in the alkylene polyamine; thus, an alkylene polyamine mixture having a % N of 34 would have an equivalent weight of 41.2.

The hydrocarbyl amines which are useful as the basic nitrogen containing compound may be hydrocarbyl amines having about 6 to about 30 carbon atoms, and in one embodiment about 8 to about 22 carbon atoms. These include fatty amines. These compounds may be saturated or unsaturated. They may be primary, secondary or tertiary amines. These hydrocarbyl amines may be prepared by reacting a fatty acid with ammonia to form a fatty acid amide, converting the amide to a nitrile, and then reducing the nitrile to the amine. Any of the fatty acids described above may be used. Examples of useful hydrocarbyl amines include oleyl amine, coconut amine, tallow amine, lauryl amine, caprylamine, isostearyl amine, stearyl amine, palmitic amine, and the like, and mixtures of two or more thereof.

The hydrocarbyl amines may be hydrocarbon substituted polyamines having a number average molecular weight in the range of about 100 to about 5000, and in one embodiment about 300 to about 4000. These may be prepared by reacting a halogen-containing hydrocarbon (e.g., chlorinated olefin polymer) with an alkylene polyamine using known techniques. Any of the olefin polymers and alkylene polyamines discussed above may be used. Examples of useful hydrocarbon substituted polyamines include polyisobutene (Mn=500–3000) substituted alkylene polyamines such as polyisobutene substituted ethylene diamine. Hydrocarbon substituted polyamines that may be used are described in U.S. Pat. Nos. 3,275,554; 3,454,555; 3,565,804; and 3,574,576, which are incorporated herein by reference.

The molybdenum compound may be any acidic molybdenum compound.

The term "acidic" is used to refer to any molybdenum compound that reacts with the basic nitrogen containing compound. Typically these molybdenum compounds are hexavalent and may be represented by the following: molybdic acid, ammonium molybdate, sodium molybdate, potassium molybdate and other alkaline metal molybdates and other molybdenum salts such as hydrogen salts, e.g., hydrogen sodium molybdate, $MoOCl_4$, $MoO_2Br_2$, $Mo_2O_3Cl_6$, molybdenum trioxide or similar acidic molybdenum compounds.

The carbon disulfide may be derived from any source. Carbon disulfide or a source material that releases carbon disulfide in solution may be used in the reaction.

The ratio of equivalents of the basic nitrogen containing compound to equivalents of the molybdenum compound may range from about 5:1 to about 1:1, and in one embodiment about 2.5:1 to about 1:1. The ratio of equivalents of the basic nitrogen containing compound to equivalents of the carbon disulfide may range from about 1:2 to about 1:0.2, and in one embodiment about 1:1.2 to about 1:0.2, and in one embodiment about 1:0.5 to about 1:0.2.

The number of equivalents of the basic nitrogen containing compound depends on the total base number (TBN) of the basic nitrogen containing compound. The equivalent weight (Eq. Wt.) of the basic nitrogen containing compound is calculated using the formula: Eq. Wt.=56100/TBN.

The weight of an equivalent of a molybdenum compound is the molecular weight of the molybdenum compound divided by the total number of molybdenum atoms present in the molecule.

The weight of an equivalent of carbon disulfide is equal to the molecular weight of carbon disulfide.

The reaction between the basic nitrogen containing compound, the molybdenum compound and the carbon disulfide may be carried out under conditions that provide for the formation of the desired molybdenum and sulfur containing composition. Typically, the reaction is carried out at a temperature in the range from about 65° C. to about 95° C., and in one embodiment from about 78° C. to about 88° C.; optionally in the presence of a normally liquid, substantially inert organic liquid solvent/diluent, until the desired product has formed.

In one embodiment, the molybdenum and sulfur containing composition may contain undesirable levels of active sulfur. This may lead to corrosion problems. This problem may be overcome by reacting the active sulfur in the molybdenum and sulfur containing composition with an effective amount of an alpha olefin, an organo phosphite or mixture thereof to eliminate the active sulfur or reduce its concentration to an acceptable non-corrosive level. The alpha-olefin may have about 8 to about 30 carbon atoms per molecule, and in one embodiment about 12 to about 24 carbon atoms. The alpha-olefin may be dodecene-1, tetradecene-1, hexadecene-1, and the like. A mixture of alpha olefins or an alpha olefin fraction may be used. The alpha olefin fractions include $C_{12-16}$ alpha-olefins, $C_{14-16}$ alpha-olefins, $C_{14-18}$ alpha-olefins, $C_{16-18}$ alpha-olefins, and the like. The organo phosphite may be an arylphosphite, alkylphosphite, aryl hydrogen phosphite, alkyl hydrogen phosphite or mixture of two or more thereof. These include triarylphosphites and dialkyl-hydrogen phosphites. Triphenyl phosphite may be used. The weight ratio of the molybdenum and sulfur containing composition to the alpha olefin, organo phosphite or mixture thereof may range from about 60:40 to about 99:1, and in one embodiment about 80:20 to about 95:5, and in one embodiment about 90:10. The temperature of the reaction between the active sulfur and the alpha olefin, organo phosphite or mixture thereof may range from about 80° C. to about 150° C., and in one embodiment about 100° C. to about 125° C.

The inventive lubricating oil composition may contain an amount of the molybdenum and sulfur containing composition sufficient to provide the lubricating oil composition with desired rust or corrosion inhibiting, antioxidant, antiwear and/or friction modifying properties. The concentration of the molybdenum and sulfur containing composition may range from about 0.1 to about 1.6% by weight, and in one embodiment from about 0.2 to about 1.5%, and in one embodiment about 0.3 to about 1.3% by weight base on the total weight of the lubricating oil composition. This amount is exclusive of solvent/diluent medium. In one embodiment, the concentration of molybdenum contributed to the inventive lubricating oil composition by the molybdenum and sulfur containing composition may range from about 25 to about 800 ppm, and in one embodiment about 50 to about 700 ppm, and in one embodiment about 100 to about 600 ppm.

The following examples are provided for the purpose of further disclosing the preparation of the molybdenum and sulfur containing composition. In these examples, as well as throughout the entire specification and the claims, unless otherwise indicated, all parts and percentages are by weight, and all temperatures are in degrees Celsius.

EXAMPLE B-1

Part A

Polyethyleneamine bottoms (1310.4 g, 31.69 eq) are charged to a 12 L, round bottomed 4 neck flask fitted with a Dean-Stark distillate trap, and equipped with a mechanical stirrer set to medium speed, a thermal probe placed in a thermowell tube, a subsurface $N_2$ sparge set at 0.3 standard cubic feet per hour and heated to 75–85° C. Isostearic acid (5923 g, 19.4 eq) is added over a 5 minute period and a 20–30° C. exotherm is observed. The reaction mixture is then heated to 220° C. over a period of 1.5 hours and held for 6.5 hours while distillates are collected in the Dean Stark Trap and discarded. The reaction mixture is then allowed to cool to 150° C. The reaction mixture is filtered over 120 g of filter aid to provide 6561 g of product. The product has a TBN of 80 milligrams of KOH per gram of sample.

Part B

To a 3-liter flask equipped with a mechanical stirrer set to medium speed, a thermal probe placed in a thermowell tube, addition funnel with a $N_2$ sparge atop set at 0.3 standard cubic feet per hour and vented to a caustic trap ($H_2S$ removal), is charged the product from Part A (830 g; 1.18 equivalents) and toluene (400 g.). The reaction mixture is heated to 40° C. over 30 minutes, then $MoO_3$ (68.2 g; 0.47 equivalents) and $H_2O$ (30 g) are added while stirring. The reaction mixture is in the form of a grey/green emulsion slurry. The reaction mixture is heated to 65° C. and the color of the reaction mixture becomes white. The heating is stopped. Carbon disulfide (99.2 g; 1.30 equivalents) is added dropwise to the reaction mixture while stirring over 15 minutes. An exotherm of 5–7° C. is observed. The reaction mixture changes color from green to dark green to very dark and slightly purple by the end of the carbon disulfide addition. The reaction mixture is then stirred and slowly heated to 85° C. The reaction mixture becomes dark brown, almost black in color. The reaction mixture is held at this temperature for 24 hours. The color of the reaction mixture changes to an amber-brown color. The reaction mixture is vacuum stripped to 145° C./10 mm Hg over 1 hour. The stripped material, which has an $H_2S$ odor, is discarded. The residue is allowed to cool to 100° C. To the residue is added a $C_{16}$–$C_{18}$ alpha olefin (111.3 g) while stirring. The reaction mixture is heated to 125° C. and stirred for 6 hours. The reaction mixture is vacuum stripped to 125° C./400 mm Hg over 1 hour. The residue is filtered through a filter aid. The filtrate is the product. The filtrate becomes a viscous solid/wax (MP=30–40° C.) after cooling to room temperature. The product has the following analysis (all percentages are by weight): TAN=36.9; TBN=37.33; %Mo=4.25; %S=3.79; %N=4.91; Viscosity @ 100° C. (cSt)=680; and Specific Gravity=0.952.

EXAMPLE B-2

To a 3-liter flask equipped with a mechanical stirrer set to medium speed, a thermal probe placed in a thermowell tube, an addition funnel with a $N_2$ sparge atop set at 0.3 standard cubic feet per hour and vented to a caustic trap ($H_2S$ removal), is added an oil solution of polyisobutene (Mn=1000) substituted succinimide (1CO:2N ratio) containing 37% by weight diluent oil (600 g), oleyl amine (200 g) and toluene (400 g). The reaction mixture is heated to 40° C. over 30 minutes, then $MoO_3$ (70 g) and $H_2O$ (44 g) are added while stirring. The reaction mixture has a gray/green color. The reaction mixture is heated to 65° C. and the color of the reaction mixture changes to white. Heating is discontinued. $CS_2$ (100 g) is added dropwise with stirring over 15 minutes. An exotherm of 5–7° C. is observed. During the addition, the reaction mixture changes color to green, then dark green. The reaction mixture is stirred and heated to 85° C. where it is held for 24 hours. At the end of this heating period the reaction mixture has a greenish-brown color. The reaction mixture is vacuum stripped to 145° C./10 mm Hg over 1 hour. A distillate, which has $H_2S$ odor, is discarded. The reaction mixture has an amber-brown color. The reaction mixture is allowed to cool to 100° C. To the reaction mixture is added post-treatments ($C_{16}$-alpha olefin and triphenylphosphite) with stirring. The reaction mixture is heated to 125° C. and stirred for 6 hours. The reaction mixture is vacuum stripped to 125° C./400 mm Hg over 1 hour. The reaction mixture is filtered using a filter aid. The filtrate, which is the product, is cooled to room temperature.

(C) Boron-Containing Compound

The boron-containing compound may be (C-I) a borated ester, (C-II) a borated epoxide; or (C-III) a mixture of (C-I) and (C-II). The borated esters (C-I) are compounds represented by one or more of the formulae (C-I-1)

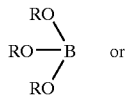

or (C-I-2)

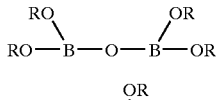

or (C-1-3)

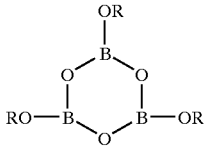

wherein each R is independently a hydrocarbon group and any two adjacent R groups may together form a cyclic group. Mixtures of two or more of the foregoing may be used. The total number of carbon atoms in the R groups in each formula is sufficient to render the compound soluble in the base oil (A). Generally, the total number of carbon atoms in the R groups is at least about 8, and in one embodiment at least about 10, and in one embodiment at least about 12. There is no limit to the total number of carbon atoms in the R groups that is required, but a practical upper limit is about 400 or about 500 carbon atoms. Examples of useful R groups include isopropyl, n-butyl, isobutyl, amyl, 4-methyl-2-pentyl, 2-ethyl-1-hexyl, isooctyl, decyl, dodecyl, tetradecyl, 2-pentenyl, dodecenyl, phenyl, naphthyl, alkylphenyl, and the like.

In one embodiment, the borated ester is represented by the formula $B(OC_5H_{11})_3$ or $B(OC_4H_9)_3$. In one embodiment, the borated ester is tri-n-butyl borate. A useful borated ester is available from Mobil under the trade designation MCP-1286.

In one embodiment, the borated ester (C-I-1) is a phenolic compound represented by the formula (C-I-1-a)

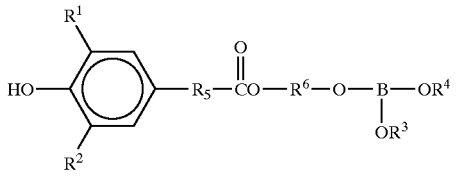

wherein in formula (C-I-1-a): $R^1$, $R^2$, $R^3$ and $R^4$ are independently hydrocarbon groups of 1 to about 12 carbon atoms; and $R^5$ and $R^6$ are independently alkylene groups of 1 to about 6 carbon atoms, and in one embodiment about 2 to about 4 carbon atoms, and in one embodiment about 2 or about 3 carbon atoms. In one embodiment, $R^1$ and $R^2$ independently contain 1 to about 6 carbon atoms, and in one embodiment each is a t-butyl group. In one embodiment, $R^3$ and $R^4$ are independently hydrocarbon groups of about 2 to about 12 carbon atoms, and in one embodiment about 8 to about 10 carbon atoms. In one embodiment, $R^5$ and $R^6$ are independently —$CH_2CH_2$— or —$CH_2CH_2CH_2$—. A useful phenolic compound is available from Crompton Corporation under the trade designation LA-2607.

In one embodiment, the borated ester (C-I-2) is a compound represented by the formula:

(C-I-2-a)

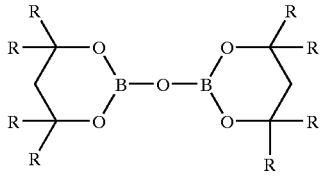

wherein in formula (C-I-2-a), each R is independently hydrogen or a hydrocarbon group. Each of the hydrocarbon groups may contain from 1 to about 12 carbon atoms, and in one embodiment 1 to about 4 carbon atoms. An example is 2,2'-oxy-bis-(4,4,6-timethyl-1,3,2-dioxaborinane).

The borated epoxide (C-II) may be made by reacting one or more epoxides with a boron reactant. Although these borated epoxides are technically boron-containing reaction products of epoxides, they are referred to herein as borated epoxides for purposes of convenience. The epoxides may be represented by the formula (C-II-1)

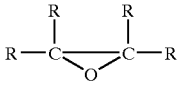

wherein in formula (C-II-1), each R is independently hydrogen or a hydrocarbon group. Any two adjacent R groups may together form a cyclic group. When a single epoxide is used the total number of carbon atoms in the R groups does not exceed about 12, and in one embodiment the total does not exceed about 10. When a mixture of epoxides is used the average on a mole basis for the total number of carbon atoms in the R groups for the mixture does not exceed about 12, and in one embodiment the total does not exceed about 10. The total number of carbon atoms in the R groups is sufficient to render the compound soluble in the base oil (A). Generally, the total number of carbon atoms in the R groups may be at least about 6, and in one embodiment at least about 8. The total number of carbon atoms in the R groups for one or more of the borated epoxides may exceed about 12 carbon atoms when a mixture of epoxides is used, but when such higher molecular borated epoxides are used they are used in combination with lower molecular weight epoxides such that the average for the total does not exceed about 12. For example, it would be permissible to use a mixture of 2 moles of 1,2-epoxy hexadecane and 4 moles of 1,2-epoxy dodecane wherein the average on a mole basis for the total number of carbon atoms in the R groups for this mixture would be 11.3. In one embodiment, the epoxide is a 1,2-epoxy alkane (e.g., 1,2-epoxy dodecane) wherein the alkane portion of the molecule has about 6 to about 12 carbon atoms, and in one embodiment about 8 to about 12 carbon atoms. The boron reactant may be boron trioxide or a boric acid. The boric acid may be metaboric acid ($HBO_2$), orthoboric acid ($H_3BO_3$) or tetraboric acid ($H_2B_4O_7$). The reaction between the epoxide and the boron reactant may be carried out at a temperature in the range of about 80° C. to about 250° C. until the desired reaction has occurred. The reaction may be carried out in the presence of a substantially inert liquid solvent-diluent such as toluene, xylene or dimethylformamide. Water is typically formed during the reaction and is distilled off. Alkaline reagents may be used to catalyze the reaction. Boron containing reaction products of epoxides are described in U.S. Pat. No. 4,584,115, which is incorporated herein by reference.

The boron-containing compound (C) may be employed in the inventive lubricating oil composition at a sufficient concentration to provide the lubricating oil composition with a boron concentration in the range of about 30 to about 600 ppm by weight based on the weight of the lubricating oil composition, and in one embodiment from about 35 to about 400 ppm by weight, and in one embodiment about 40 to about 200 ppm by weight.

(D) Phosphorus-Containing Compound

The optional phosphorus-containing compound, which typically functions as an extreme pressure (EP) and/or antiwear additive, may be a metal salt of a compound represented by the formula (D-I)

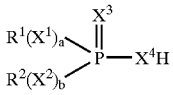

wherein in formula (D-I): $X^1$, $X^2$, $X^3$ and $X^4$ are independently oxygen or sulfur, a and b are independently zero or one, and $R^1$ and $R^2$ are independently hydrocarbyl groups. Useful phosphorus-containing acids are phosphorus- and sulfur-containing acids. These include those acids wherein in formula (D-I) $X^3$ and $X^4$ are sulfur, $X^1$ and $X^2$ are oxygen, and a and b are each 1.

$R^1$ and $R^2$ in formula (D-I) are independently hydrocarbyl groups that are usually free from acetylenic and ethylenic unsaturation. In one embodiment, $R^1$ and $R^2$ independently have from about 1 to about 50 carbon atoms, and in one embodiment from about 1 to about 30 carbon atoms, and in one embodiment from about 3 to about 18 carbon atoms, and in one embodiment from about 3 to about 8 carbon atoms. Each $R^1$ and $R^2$ can be the same as the other, although they may be different and either or both may be mixtures. Examples of $R^1$ and $R^2$ groups include isopropyl, n-butyl, isobutyl, amyl, 4-methyl-2-pentyl, isooctyl, decyl, dodecyl, tetradecyl, 2-pentenyl, 2-ethylhexyl, dodecenyl, phenyl, naphthyl, alkylphenyl, and mixtures thereof. Examples of useful mixtures include: isopropyl/n-butyl; isopropyl/4-methyl-2-pentyl; isopropyl/2-ethylhexyl; isopropyl/isooctyl; isopropyl/decyl; isopropyl/dodecyl; isopropyl/tridecyl; and isobutyl/primary amyl.

In one embodiment, the phosphorus-containing compound represented by formula (D-I) is a compound where a and b are each 1, $X^1$ and $X^2$ are each O, and $R^1$ and $R^2$ are derived from a mixture of primary alcohols, a mixture of secondary alcohols, or a mixture of at least one primary alcohol and at least one secondary alcohol. Examples of useful alcohol mixtures include: a mixture of about 40 to about 60 mole % 4-methyl-2-pentyl alcohol and about 60 to about 40 mole % isopropyl alcohol; a mixture of about 40 mole % isooctyl alcohol and about 60 mole % isopropyl alcohol; a mixture of about 40 mole % 2-ethylhexyl alcohol and about 60 mole % isopropyl alcohol; and a mixture of about 35 mole % primary amyl alcohol and about 65 mole % isobutyl alcohol.

The metal salts of the phosphorus-containing acids represented by formula (D-I) which are useful include those salts containing Group IA, IIA or IIB metals, aluminum, lead, tin, iron, molybdenum, manganese, cobalt, nickel or bismuth. Zinc is a useful metal. These salts may be neutral salts or overbased salts. Examples of useful metal salts of phosphorus-containing acids, and methods for preparing such salts are found in the prior art such as U.S. Pat. Nos. 4,263,150, 4,289,635; 4,308,154; 4,322,479; 4,417,990; and 4,466,895, which are incorporated herein by reference.

The phosphorus-containing compound (D) may be employed in the inventive lubricating oil composition at a concentration in the range of up to about 1.0% based on the weight of the lubricating oil composition, and in one embodiment up to about 0.8% by weight, and in one embodiment up to about 0.6% by weight, and in one embodiment up to about 0.5% by weight.

The invention also contemplates the use of other additives in the inventive lubricating oil composition. These additives include, for example, detergents and dispersants of the ash-producting or ashless type, corrosion-inhibiting agents, oxidation-inhibiting agents, viscosity index modifiers, dispersant viscosity index modifiers, pour point depressing agents, extreme pressure agents, antiwear agents, friction modifiers, anti-foam agents, and the like. Each of the foregoing additives, when used, is used at a functionally effective amount to impart the desired properties to the lubricant. Thus, for example, if an additive is a corrosion inhibitor, a functionally effective amount of this corrosion inhibitor would be an amount sufficient to impart the desired corrosion inhibition characteristics to the lubricant. Generally, the concentration of each of these additives, when used, ranges up to about 20% by weight based on the weight of the lubricating oil composition, and in one embodiment from about 0.001% to about 20% by weight, and in one embodiment about 0.01% to about 10% by weight based on the weight of the lubricating oil composition.

The molybdenum and sulfur containing composition (B), boron containing compound (C), optional phosphorus containing compound (D) as well as any of the above mentioned other additives may be added directly to the lubricating oil composition. In one embodiment, however, they are diluted with a substantially inert, normally liquid organic diluent such as mineral oil, synthetic oil, naphtha, alkylated (e.g. $C_{10}$–$C_{13}$ alkyl) benzene, toluene or xylene to form an additive concentrate. The additive concentrate may then be added to the lubricating oil composition. These concentrates usually contain from about 1% to about 99% by weight, and in one embodiment about 10% to about 90% by weight of such diluent.

EXAMPLES 1-3 AND X-1 TO X-3

Table 1 below discloses Examples 1-3 which are ILSAC GF-4 lubricating oil compositions within the scope of the invention. Examples X-1 to X-3, which are outside the scope of the invention but provided for comparative purposes, are also disclosed in Table 1. In Table 1 all numerical values relating to ingredients of the exemplified lubricating oil compositions (except for the Mo, B and anti-foam agent concentrations) are in percent by weight of the lubricating oil composition. The Mo, B and anti-foam agent concentrations are in parts per million (ppm). The molybdenum, boron and phosphorus concentrations are theoretical.

The exemplified lubricating oil compositions are tested using the GF-3/GF-4 Sequence VIII Bearing Corrosion Engine Test and the results of these tests are disclosed in Table 1. This test is designed to evaluate crankcase lubricant oils for their copper and lead corrosion control capabilities. The results are reported in milligrams of total weight loss of the top and bottom crankshaft bearings. The lower the weight loss, the better. The pass/fail limit may be considered to be 26.4 mg.

TABLE 1

| Example | 1 | 2 | 3 | X-1 | X-2 | X-3 |
|---|---|---|---|---|---|---|
| Group II base oil | 81.29 | 80.48 | 81.13 | 81.48 | 81.53 | 80.11 |
| Viscosity modifier: ethylene-propylene copolymer (90.9% diluent oil) | 7.8 | 7.8 | 7.2 | 7.2 | 7.2 | 7.8 |
| Pour point dispersant: Styrene-maleic anhydride copolymer dispersed in oil (53.6% diluent oil) | 0.3 | 0.3 | 0.3 | 0.3 | 0.3 | 0.3 |
| Dispersant: Polyisobutene (Mn = 2000) substituted succinimide (45% diluent oil) | 5.1 | 5.1 | 5.1 | 5.1 | 5.1 | — |
| EP Additive: zinc dialkyl dithiophosphate dispersed in oil (9% diluent oil) | 0.50 | 0.50 | 0.50 | 0.50 | 0.50 | 0.48 |
| Antioxidant: Nonylated diphenyl amine | 0.70 | 0.70 | 0.70 | 0.70 | 0.70 | 1.0 |
| Antioxidant: Sulfurized olefin from Diels Alder reaction of butadiene and butyl acrylate | 0.20 | 0.20 | 0.20 | 0.20 | 0.20 | 0.30 |
| Antioxidant: Hindered phenolic ester | 0.20 | 0.20 | 0.20 | 0.20 | 0.20 | 1.20 |

TABLE 1-continued

| Example | 1 | 2 | 3 | X-1 | X-2 | X-3 |
|---|---|---|---|---|---|---|
| Friction modifier: glycerol monooleate | 0.20 | 0.20 | 0.20 | 0.20 | 0.20 | 0.20 |
| Detergent: calcium sulfonate dispersed in oil, TBN = 300 (42% diluent oil) | 0.88 | 0.88 | 0.88 | 0.88 | 0.88 | 0.88 |
| Detergent: calcium sulfonate dispersed in oil, TBN = 400 (42% diluent oil) | 0.65 | 0.65 | 0.65 | 0.65 | 0.65 | 0.65 |
| Diluent oil | 1.37 | 1.37 | 1.37 | 1.37 | 1.37 | 1.37 |
| Anti-foam agent: polydimethyl siloxane (87.5% diluent oil) (ppm) | 90 | 90 | 90 | 90 | 90 | 90 |
| Product of Example B-1 | 0.61 | 1.22 | — | 1.22 | — | 0.61 |
| Product of Example B-2 | — | — | 1.17 | — | 1.17 | — |
| Tri-n-butyl borate | 0.20 | 0.40 | 0.40 | — | — | — |
| Borated polyisobutene (Mn = 2000) substituted succinimide dispersed in diluent oil | — | — | — | — | — | 5.1 |
| Mo concentration (ppm) | 250 | 500 | 500 | 500 | 500 | 250 |
| Boron concentration (ppm) | 90 | 180 | 180 | 0 | 0 | 90 |
| Phosphorus concentration | 0.05 | 0.05 | 0.05 | 0.05 | 0.05 | 0.05 |
| Viscosity Grade | 5W-30 | 5W-30 | 5W-30 | 5W-30 | 5W-30 | 5W-30 |
| GF-3/GF-4 Sequence VIII (mg) | 13.5 18.9 | 10.7 | 13.8 | 43.1 | 87.4 | 35.0 |

The foregoing examples show improved GF-3/GF-4 Sequence VIII performance when the inventive lubricating oil compositions are used, In particular, a comparison of Example 3 with Example X-2 indicates significant improvement in the GF-3/GF-4 Sequence VIII results when the boron compound is added. Example X-3 indicates that the use of a borated polyisobutene substituted succinimide as the boron source results in a failure for the GF-3/GF-4 Sequence VIII test.

While the invention has been explained in relation to specific embodiments, it is to be understood that various modifications thereof will become apparent to those skilled in the art upon reading the specification. Therefore, it is to be understood that the invention disclosed herein is intended to cover such modifications as fall within the scope of the appended claims.

What is claimed is:

1. A lubricating oil composition, comprising:

(A) a base oil;

(B) a molybdenum and sulfur containing composition derived from a basic nitrogen containing compound, a molybdenum compound and carbon disulfide;

(C) a borated ester represented by one or more of the formulae (C-I-1)

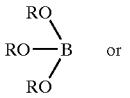

or (C-I-2)

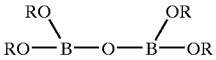

or

-continued (C-1-3)

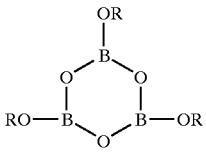

wherein in formulae (C-I-1), (C-I-2) and (C-I-3), each R is independently isopropyl, n-butyl, isobutly, amyl, 4-methyl-2-pentyl, 2-ethyl-1-hexyl, isoctyl, decyl or dodecyl; and (D) optionally a zinc dialkyl dithiophoshate, provided the phosphorus content of the lubricating oil composition does not exceed about 0.10% by weight.

2. The composition of claim 1 wherein the basic nitrogen containing compound is reacted with the molybdenum compound to form a molybdenum containing intermediate, and the molybdenum containing intermediate is reacted with carbon disulfide to form the molybdenum and sulfur containing composition.

3. The composition of claim 1 wherein the basic nitrogen containing compound is reacted with the carbon disulfide to form a sulfur containing intermediate, and then the sulfur containing intermediate is reacted with the molybdenum compound to form the molybdenum and sulfur containing composition.

4. The composition of claim 1 wherein the basic nitrogen containing compound is the product made by reacting a carboxylic acid or reactive equivalent thereof with an alkylene polyamine.

5. The composition of claim 1 wherein the basic nitrogen containing compound is a hydrocarbyl amine.

6. The composition of claim 1 wherein the basic nitrogen containing compound comprises a mixture of a hydrocarbyl amine and the product made by reacting a carboxylic acid or reactive equivalent thereof with an alkylene polyamine.

7. The composition of claim 4 wherein the carboxylic acid or reactive equivalent thereof has about 8 to about 34 carbon atoms per molecule.

8. The composition of claim 4 wherein the carboxylic acid or reactive equivalent thereof is a fatty acid.

9. The composition of claim 4 wherein the carboxylic acid or reactive equivalent thereof is hydrocarbon substituted carboxylic or reactive equivalent thereof made by reacting one or more alpha, beta olefinically unsaturated carboxylic acid reagents containing 2 to about 20 carbon atoms, exclusive of the carboxyl groups, with one or more olefin polymers.

10. The composition of claim 4 wherein the alkylene polyamine is a compound represented by the formula

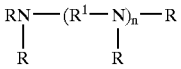

wherein n is from 1 to about 14; each R is independently a hydrogen atom, a hydrocarbyl group or a hydroxy-substituted or amine-substituted hydrocarbyl group having up to about 30 atoms, or two R groups on different nitrogen atoms are joined together to form a $R^1$ group, with the proviso that at least one R group is a hydrogen atom, and $R^1$ is an alkylene group of about 1 to about 10 carbon atoms.

11. The composition of claim 4 wherein the carboxylic acid or reactive equivalent thereof is isostearic acid and the alkylene polyamine comprises alkylene polyamine bottoms.

12. The composition of claim 6 wherein the hydrocarbyl amine is oleyl amine and the product made by reacting a carboxylic acid or reactive equivalent thereof with an alkylene polyamine is a polyisobutene substituted succinimide.

13. The composition of claim 1 wherein the molybdenum compound is $MoO_3$.

14. The lubricating oil composition of claim 1 wherein the lubricating oil composition further comprises a detergent, dispersant, corrosion-inhibiting agent, oxidation-inhibiting agent, viscosity index modifier, dispersant viscosity index modifier, pour point depressing agent, extreme pressure agent, antiwear agent, friction modifier, anti-foam agent, or mixture of two or more thereof.

15. A lubricating oil composition, comprising:

(A) a base oil;

(B) a molybdenum and sulfur containing composition derived from; the product made by reacting a fatty acid with an alkylene polyamine; $MoO_3$; and carbon disulfide;

(C) a borated ester represented by one or more of the formulae (C-I-1)

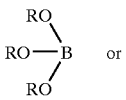

or (C-I-2)

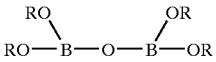

or (C-1-3)

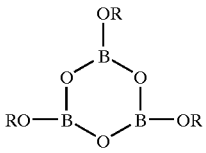

wherein a formulate (C-I-1), (C-I-2) and (C-I-3), each R is independently isopropyl, n-butyl, isobutyl, amyl, 4-methyl-2-pentyl, 2-ethyl, isoctyl, decyl or dodecyl, and (D) optionally a zinc dialkyl dithiophosphate, provided the phosphorus content of the lubricating oil composition does not exceed about 0.10% by weight.

16. A lubricating oil composition, comprising:

(A) a base oil;

(B) a molybdenum and sulfur containing composition derived from; a polyisobutene substituted succinimide; oleyl amine; $MoO_3$; and carbon disulfide;

(C) a borated ester represented by one or more of the formulae (C-I-1)

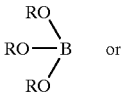

or (C-I-2)

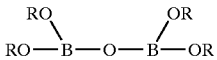

or (C-1-3)

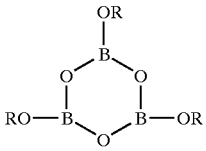

wherein in formulate (C-I-1), (C-I-2) and (C-I-3), each R is independently isopropyl, n-butyl, isobutyl, amyl, 4-methyl-2-pentyl, 2-ethyl-1-hexyl, isococtyl, decyl or dodecyl; and (D) optionally a zinc dialkyl dithiophosphate, provided the phosphorus content of the lubricating oil composition does not exceed about 0.10% by weight.

17. A lubrication oil composition, comprising:

(A) a base oil;

(B) a molybdenum and sulfur containing composition derived from a basic nitrogen containing compound, a molybdenum compound and carbon disulfide;

(C) tri-n-butyl borate; and (D) optionally a phosphorus containing compound, provided the phosphorus content of the lubricating oil composition does not exceed about 0.10% by weight.

18. A lubricating oil composition, comprising:

a base oil;

(B) a molybdenum and sulfur containing composition derived from a basic nitrogen containing compound, a molybdenum compound and carbon disulfide;

(C) tri-2-ethyl hexyl borate; and (D) optionally a phosphorus containing compound, provided the phosphorus content of the lubricating oil composition does not exceed about 0.10% by weight.

* * * * *